United States Patent [19]

Olson et al.

[11] Patent Number: 4,933,239

[45] Date of Patent: Jun. 12, 1990

[54] ALUMINIDE COATING FOR SUPERALLOYS

[75] Inventors: Walter E. Olson; Dinesh K. Gupta, both of Vernon, Conn.

[73] Assignee: United Technologies Corporation, Hartford, Conn.

[21] Appl. No.: 319,593

[22] Filed: Mar. 6, 1989

[51] Int. Cl.[5] ..... B22F 7/04

[52] U.S. Cl. ..... 428/557; 428/615; 428/652; 428/660; 428/663; 428/678; 428/220; 428/457; 428/908.8; 419/8; 419/9; 419/30; 419/38; 427/34; 427/250

[58] Field of Search ..... 427/34, 250, 191; 428/908.8, 215, 615, 633, 652, 678, 220, 652, 574, 663; 419/8, 9, 30, 38

[56] References Cited

U.S. PATENT DOCUMENTS

| | | | |
|---|---|---|---|
| Re. 30,995 | 7/1982 | Rairden, III | 428/680 |
| Re. 31,339 | 8/1983 | Dardi et al. | 428/678 |
| Re. 32,121 | 4/1986 | Gupta et al. | 428/656 |
| 3,129,069 | 4/1964 | Hanink et al. | 428/937 |
| 3,594,219 | 7/1971 | Maxwell et al. | 117/131 |
| 3,819,338 | 6/1974 | Bungardt et al. | 428/652 |
| 3,869,779 | 3/1975 | Gedwill et al. | 29/194 |
| 3,873,347 | 3/1975 | Walker et al. | 117/71 |
| 3,874,901 | 4/1975 | Rairden, III | 117/71 |
| 3,918,139 | 11/1975 | Felten | 29/194 |
| 3,961,098 | 6/1976 | Bessen | 427/34 |
| 3,961,910 | 6/1976 | Baladjanian et al. | 428/652 |
| 3,979,273 | 9/1976 | Panzera et al. | 204/192 |
| 3,999,956 | 12/1976 | Stueber et al. | 29/194 |
| 4,005,989 | 2/1977 | Preston | 29/194 |
| 4,024,294 | 5/1977 | Rairden, III | 427/42 |
| 4,070,507 | 1/1978 | Stueber et al. | 427/252 |
| 4,080,486 | 3/1978 | Walker et al. | 428/653 |
| 4,101,713 | 7/1978 | Hirsch et al. | 428/554 |
| 4,117,179 | 9/1978 | Jackson et al. | 427/405 |
| 4,123,594 | 10/1978 | Chang | 428/651 |
| 4,123,595 | 10/1978 | Chang | 428/667 |
| 4,152,223 | 5/1979 | Wallace et al. | 204/37 |
| 4,198,442 | 4/1980 | Gupta et al. | 427/34 |
| 4,246,323 | 1/1981 | Bornstein et al. | 428/678 |
| 4,371,570 | 2/1983 | Goebel et al. | 427/248.1 |
| 4,382,976 | 5/1983 | Restall | 427/34 |
| 4,714,624 | 12/1987 | Naik | 427/34 |

OTHER PUBLICATIONS

Metallurgical Coatings 1988, R. C. Krutenat (Ed), vol. 1, Elsevier Applied Science, pp. 61–74.

*Primary Examiner*—Stephen J. Lechert, Jr.
*Assistant Examiner*—Nina Bhat
*Attorney, Agent, or Firm*—J. M. Rashid

[57] ABSTRACT

A protective coating system for superalloys is described. The coating is an active element enriched aluminide, and can be formed by aluminizing an overlay coated superalloy, wherein during the aluminizing process, aluminum diffuses completely through the overlay coating and into the substrate. The coating system exhibits desirable oxidation resistance and resistance to thermal fatigue cracking, due to the presence of oxygen active elements in the overlay.

17 Claims, 2 Drawing Sheets

ALUMINIDE COATING FOR SUPERALLOYS

TECHNICAL FIELD

The present invention relates to protective coatings for metal substrates. More particularly, the present invention relates to coatings for gas turbine engine components.

BACKGROUND

The superalloys are a class of materials which exhibit desirable mechanical properties at high temperatures. These alloys generally contain major amounts of nickel, cobalt and/or iron either alone or in combination, and alloying additions of elements such as chromium, aluminum, titanium, and the refractory metals. Superalloys have found numerous applications in gas turbine engines.

In most gas turbine applications, it is important to protect the surface of the engine component from oxidation and corrosion degradation, as such attack may materially shorten the useful life of the component, and cause significant performance and safety problems.

Coatings can be used to protect superalloy engine components from oxidation and corrosion. The well known family of coatings commonly referred to as MCrAlY coatings, where M is selected from the group consisting of iron, nickel, cobalt, and various mixtures thereof, can markedly extend the service life of gas turbine engine blades, vanes, and like components. MCrAlY coatings are termed overlay coatings, denoting the fact that they are deposited onto the superalloy surface as an alloy, and do not interact significantly with the substrate during the deposition process or during service use. As is well known in the art, MCrAlY coatings can be applied by various techniques such as physical vapor deposition, sputtering, or plasma spraying. MCrAlY coatings may also include additions of noble metals, hafnium, or silicon, either alone or in combination. They may also include other rare earth elements in combination with or substitution for yttrium. See, e.g., the following U.S. Patents which are incorporated by reference: U.S. Pat. Nos. 3,542,530, 3,918,139, 3,928,026, 3,993,454, 4,034,142, and Re. 32,121.

U.S. Pat. No. Re. 32,121 states that MCrAlY coatings are the most effective coatings for protecting superalloys from oxidation and corrosion attack.

Aluminide coatings are also well known in the art as capable of providing oxidation and corrosion protection to superalloys. See, for example, U.S. Pat. Nos. 3,544,348, 3,961,098, 4,070,507 and 4,132,816, which are incorporated by reference.

During the aluminizing process there is significant interaction between the aluminum and the substrate; the substrate chemistry and deposition temperature exert a major influence on coating chemistry, thickness and properties. A disadvantage of aluminide coatings is that in the thicknesses required for optimum oxidation and corrosion resistance, generally taught by the prior art to be about 0.0035 inches, the coatings are brittle and can crack when subjected to the stresses which gas turbine engine blades and vanes typically experience during service operation. These cracks may propagate into the substrate and limit the structural life of the superalloy component; the tendency to crack also results in poor oxidation and corrosion resistance, as discussed in U.S. Pat. Nos. 3,928,026, 4,246,323, 4,382,976, and Re. 31,339.

Aluminide coatings less than about 0.0035 inches thick may have improved crack resistance, but the oxidation resistance of such thin aluminides is not as good as that of the MCrAlY coatings.

In U.S. Pat. Nos. 3,873,347 and 4,080,486, an attempt is made to combine the advantages of overlay coatings and aluminide coatings. In both patents, an MCrAlY coating, preferably 0.003–0.005 inches thick, is aluminized in a pack cementation process, and a high concentration of aluminum is formed at the outer surface of the MCrAlY coating, which improves the high temperature oxidation resistance of the coating as compared to the untreated MCrAlY.

According to U.S. Pat. No. Re. 30,995, in order to prevent cracking and spalling of an aluminized MCrAlY coating from the substrate, the aluminum must not diffuse into the substrate; aluminum may diffuse no closer than 0.0005 inches to the MCrAlY/substrate interface. It is also stated that the aluminum content in the aluminized MCrAlY must be less than ten weight percent, in order to achieve the best combination of coating properties.

In U.S. Pat. No. 3,961,098, an MCr powder is flame sprayed onto a metallic substrate in such a manner that the powder particles are substantially non-molten when they strike the substrate surface. Aluminum is subsequently diffused through the overlay coating, and into the substrate surface. Laboratory tests revealed that the aluminizing step must be conducted so that the final aluminum concentration in the coating is less than 20 weight percent, or else the coating will be brittle, and will have unacceptable corrosion and oxidation resistance.

U.S. Pat. No. 4,246,323 teaches a process for enriching an MCrAlY coating with aluminum. The processing is conducted so that Al diffuses only into the outer surface of the MCrAlY. The outer, aluminum rich portion of the coating is reported to be resistant to oxidation degradation, and the inner, unaluminized MCrAlY reportedly is said to have good mechanical properties.

In U.S. Pat. No. Re. 31,339 an MCrAlY coated superalloy component is aluminized, and then the coated component is hot isostatically pressed. A substantial increase in coating life is reported, which is attributed to the presence of a large reservoir of an aluminum rich phase in the outer portion of the MCrAlY. As in the patents discussed above, the aluminum diffuses only into the MCrAlY outer surface. U.S. Pat. No. 4,152,223 discloses a process similar to that of U.S. Pat. No. Re. 31,339, in which an MCrAlY coated superalloy is surrounded by a metallic envelope, and then hot isostatically pressed to close any defects in the MCrAlY coating and to diffuse a portion of metallic the envelope into the overlay. If aluminum foil is used as the envelope, the foil may melt during hot isostatic pressing and form intermetallic compounds with the substrate. It is stated that these compounds may enhance the oxidation resistance of the coating. However, such intermetallics may have an undesired effect on the fatigue strength of the coated component.

In U.S. Pat. No. 4,382,976, an MCrAlY coated superalloy component is aluminized in a pack process wherein the pressure of the inert carrier gas is cyclicly varied. Aluminum reacts with the MCrAlY to form various intermetallic, aluminum containing phases. The extent of aluminum diffusion into the substrate alloy was reported to be significantly less than if the aluminizing were carried out directly on the substrate.

In U.S. Pat. No. 4,101,713, high energy milled MCrAlY powders are applied to superalloy substrates by flame spray techniques. It is stated that the coated component can be aluminized, whereby aluminum would diffuse into the MCrAlY coating, and if desired, into the substrate material. However, according to U.S. Patent No. Re. 30,995 (issued to the same inventor) diffusion of aluminum into the substrate may cause spalling of the MCrAlY coating from the substrate.

Other U.S. Patents which disclose aluminized MCrAlY coatings are 3,874,901 and 4,123,595.

Other patents which indicate the general state of the art relative to coatings for superalloys include U.S. Pat. Nos. 3,676,085, 3,928,026, 3,979,273, 3,999,956, 4,005,989, 4,109,061, 4,123,594, 4,132,816, 4,198,442, 4,248,940, and 4,371,570.

As the operating conditions for superalloy components become more severe, further improvements are required in oxidation and corrosion resistance, and resistance to thermal mechanical fatigue. As a result, engineers are continually seeking improved coating systems for superalloys. The aforementioned advances in coating technology have markedly improved resistance to oxidation degradation. However, these advances have failed to address what is now viewed as the life limiting property for coated superalloys: resistance to thermal mechanical fatigue cracking.

DISCLOSURE OF THE INVENTION

It is an object of the present invention to provide an improved coating system for superalloys.

Yet another object of the present invention is a low cost coating system for superalloys.

Another object of the present invention is a coating system for superalloys which has improved resistance to oxidation degradation, and improved resistance to thermal mechanical fatigue.

Yet another object of the present invention is a coating system for superalloys which has the oxidation resistance of overlay coatings, and the resistance to thermal mechanical fatigue cracking of thin aluminide coatings.

This invention is a superalloy component characterized by a diffusion aluminide coating which also contains small amounts of yttrium, silicon and hafnium. The coating has the oxidation resistance of currently used overlay coatings, and thermal fatigue life which is significantly better than such overlay coatings and equal to that of the best aluminide coatings.

The coating of the present invention may be produced by applying a thin, nominally 0.0015 inch, overlay coating which contains yttrium, silicon and hafnium to the surface of a superalloy substrate, and then subjecting the overlay coated component to a pack aluminizing process wherein aluminum from the pack diffuses into and through the overlay coating and into the superalloy substrate. The resultant invention coating has a duplex microstructure, and is about 0.001 to 0.004 inches thick; the outer zone of the duplex microstructure ranges from between about 0.0005 to about 0.003 inches, and comprises about 20–35 weight percent aluminum enriched with about 0.1–5.0 weight percent yttrium, about 0.1–7.0 weight percent silicon and about 0.1–2.0 weight percent hafnium. The high aluminum content in the outer zone provides optimum oxidation resistance, and the presence of yttrium, silicon and hafnium improve the adherence of the alumina scale which forms during high temperature use of the coated component.

The coating of this invention has better oxidation resistance than current aluminide coatings, and comparable or better oxidation resistance than current overlay coatings. The inner, or diffusion coating zone contains a lesser concentration of aluminum than the outer zone, but a greater concentration of aluminum than the substrate. The diffusion zone acts to reduce the rate of crack propagation through the coating and into the substrate. As a result, components made according to the present invention have improved resistance to thermal mechanical fatigue cracking relative to overlay coated specimens, and comparable resistance to thermal mechanical fatigue cracking relative to specimens coated with the most crack resistant aluminides.

The primary advantage of the coating of the present invention is that it combines the desired properties of aluminide coatings and overlay coatings to a degree never before achieved.

Another advantage of the coating of the present invention is that it is easily applied using techniques well known in the art.

The foregoing and other objects, features and advantages of the present invention will become more apparent in the light of the following detailed description of the preferred embodiments thereof as illustrated in the accompanying drawing.

BEST MODE FOR CARRYING OUT THE INVENTION

The present invention is a modified diffusion aluminide coating which contains small but effective amounts of yttrium, silicon and hafnium. The coating is produced by first applying a thin overlay coating to the surface of the superalloy, and then aluminizing the overlay coated component. The resultant coating microstructure is similar to the microstructure of aluminide coatings, but contains yttrium, silicon and hafnium in sufficient concentrations to markedly improve the coating oxidation resistance. Unlike simple overlay coatings, the coating of the present invention includes a diffusion zone which is produced during the aluminizing step, which, as will be described below, results in the coated component having desirable thermal mechanical fatigue strength and other desirable properties.

The coating has particular utility in protecting superalloy gas turbine engine components from oxidation and corrosion degradation, and has desirable resistance to thermal fatigue. Blades and vanes in the turbine section of such engines are exposed to the most severe operating conditions, and as a result, the coating of the present invention will be most useful in such applications.

Figure 1:
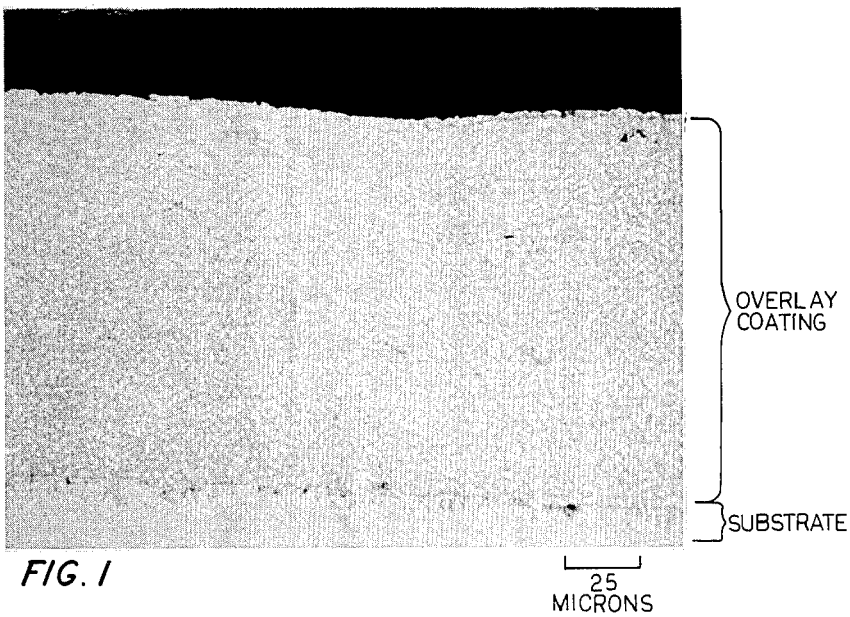
FIG. 1 is a photomicrograph of an overlay coating useful in producing the coating according to the present invention.
Figure 2:
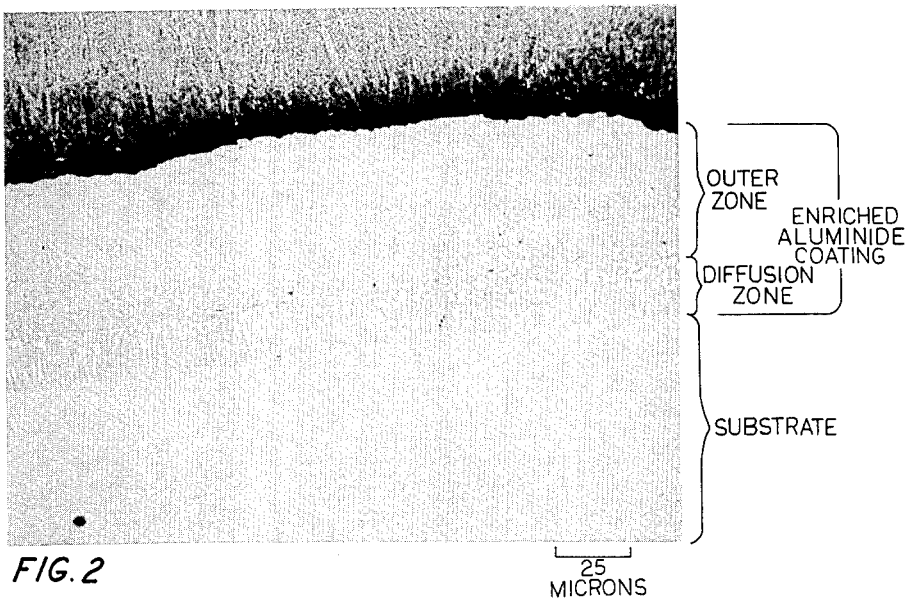
FIG. 2 is a photomicrograph of the coating according to the present invention.

The coating of the present invention is best described with reference to FIGS. 1 and 2. FIG. 1 is a photomicrograph of a NiCoCrAlY overlay coating which also contains silicon and hafnium, applied to the surface of a nickel base superalloy. As is typical of overlay coatings, the overlay coating forms a discrete layer on the superalloy surface; there is no observable interaction or diffusion zone between the overlay coating and the substrate. FIG. 2 is a photomicrograph showing the microstructure of the coating of the present invention; the coating was etched with a solution of 50 milliliters (ml) lactic acid, 35 ml nitric acid, and 2 ml hydrofluoric acid. The coating shown in FIG. 2 was produced by aluminizing the overlay coating of FIG. 1 in a manner described in more detail below. Metallographically, it is seen that the coating of the present invention has a duplex microstructure, characterized by an outer zone and inner zone between the outer zone and substrate. (The inner zone is sometimes referred to as a diffusion zone.) Electron microprobe microanalysis has indicated that on a typical nickel base superalloy, the outer zone nominally contains, on a weight percent basis, about 20–35 Al, about 0.1–5.0 Y, about 0.1–7.0 Si, about 0.1–2.0 Hf, about 10–40 Co, and about 5–30 Cr, with the balance nickel. As will be described in further detail below, the final outer zone composition results from the addition of about 5–30% Al to the preexisting overlay coating composition during the aluminizing process. The diffusion zone contains a lesser concentration of aluminum than the outer zone, and a greater concentration of aluminum than the substrate; it also contains elements of the substrate. The diffusion zone also may include (Ni,Co)Al intermetallic compounds, nickel solid solution, and various yttrium containing compounds. The microstructure is metallographically similar to that of many aluminide coatings. Since the coating also includes yttrium, silicon and hafnium, the coating of the present invention can be referred to as a diffusion aluminide coating enriched with oxygen active elements.

Figure 3:
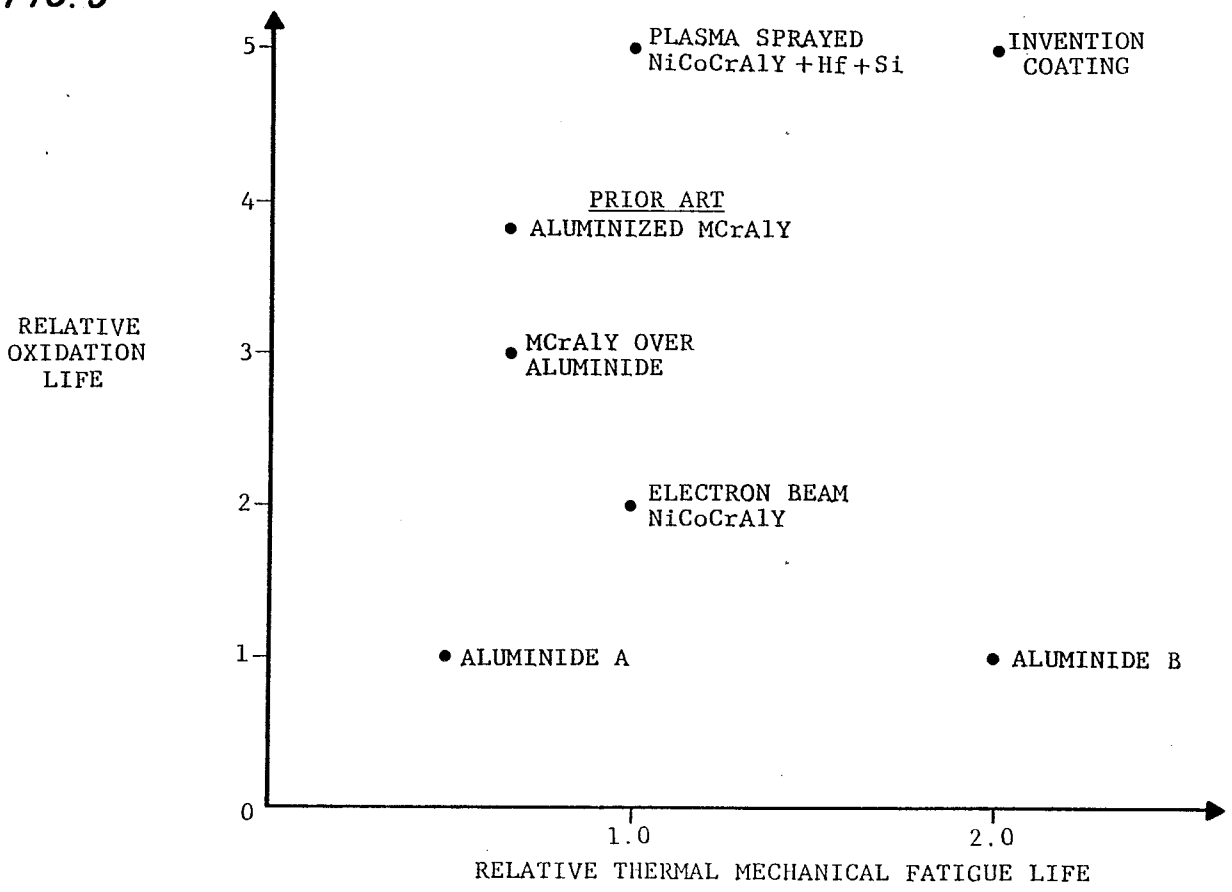
FIG. 3 shows comparative oxidation and thermal mechanical fatigue behavior of several coatings, including the coating of the present invention.

FIG. 3 presents the Relative Oxidation Life as a function of Relative Thermal Mechanical Fatigue Life for seven coatings applied to a commercially used nickel base superalloy. Relative Oxidation Life is a measure of the time to cause a predetermined amount of oxidation degradation of the substrate; in tests to determine the Relative Oxidation Life of such coatings, laboratory specimens were cycled between exposures at 2,100° F for 55 minutes and 400° F for 5 minutes. Relative Thermal Mechanical Fatigue Life is a measure of the number of cycles until the test specimen fractures in fatigue. Test specimens were subjected to a constant tensile load while being thermally cycled to induce an additional strain equal to $\alpha\Delta T$, where $\alpha$ is the substrate coefficient of thermal expansion, and $\Delta T$ is the temperature range over which the specimen was cycled. The test conditions were chosen to simulate the strain and temperature cycling of a blade in the turbine section of a gas turbine engine.

Referring to FIG. 3, the Plasma Sprayed NiCoCrAlY+Hf+Si overlay is representative of the coating described in U.S. Pat. No. Re. 32,121. The Electron Beam NiCoCrAlY is representative of the coating described in U.S. Pat. No. 3,928,026. The MCrAlY over Aluminide coating is representative of the coating described in U.S. Patent No. 4,005,989. The coating denoted "Prior Art Aluminized MCrAlY" was a 0.006 inch NiCoCrAlY coating which was aluminized using pack cementation techniques to cause diffusion of Al into the outer 0.002 inches of the overlay.

Aluminide A is representative of a diffusion coating produced by a pack cementation process similar to that described in U.S. Pat. No. 3,544,348. Aluminide B is representative of a diffusion coating produced by a gas phase deposition process similar to that described in U.S. Pat. No. 4,132,816, but with slight modifications to enhance the thermal fatigue resistance of the coated component. The coating denoted "Invention Coating" had a microstructure similar to that shown in FIG. 2, and was produced by aluminizing a thin overlay according to the process described below.

As is apparent from FIG. 3, the coating of the present invention exhibits resistance to oxidation degradation which is comparable to the most oxidation resistant coating which was tested. Also, the coating of the present invention exhibits resistance to thermal mechanical fatigue which is comparable to the most crack resistant coating which was tested. Thus, a desired combination of properties is achieved by the coating of this invention.

The coating of the present invention is produced using techniques known in the art. One method is by aluminizing an overlay coated superalloy using pack cementation techniques. In the present invention, the overlay is relatively thin: less than about 0.003 inches thick and preferably between about 0.0005 and 0.0015 inches thick. The aluminizing process is carried out so that the resultant aluminum content in the outer coating zone is at least about 20%. It is believed that the desirable oxidation resistance of the coating of the present invention is due to the presence of yttrium, silicon and hafnium in the outer coating zone which contains such a high aluminum content. The high aluminum content provides good resistance to oxidation degradation, and the presence of yttrium, silicon and hafnium results in improved alumina scale adherence, and a resultant reduced rate of aluminum depletion from the coating. That the coating of the present invention has improved fatigue properties (FIG. 3) when the aluminum content is greater than 20% is surprising, and contrary to the teachings of the prior art. See, for example, U.S. Pat. No. 3,961,098. The favorable resistance to thermal mechanical fatigue cracking is believed due to the thinness of the coating and the interaction of the inner and outer coating zones. The combined thickness of the outer and inner zones should be about 0.001 to 0.005 inches, preferably about 0.002 to 0.003 inches. If a crack forms in the outer zone, the propagation rate of the crack will be relatively low due to the thinness of the outer zone. Once the crack reaches the diffusion zone, the crack surfaces will begin to oxidize, because the diffusion zone contains a lesser concentration of aluminum than the outer zone. As the crack oxidizes, the surfaces of the crack will become rough, and the crack tip will become blunted thereby reducing its propagation rate.

As noted above, the diffusion zone may contain elements of the substrate. Superalloys generally contain refractory elements such as tungsten, tantalum, molybdenum and columbium (niobium) for solid solution strengthening, as discussed in U.S. Pat. No. 4,402,772. During the elevated temperature aluminizing process, these elements tend to migrate into the diffusion zone. Some refractory elements are known to decrease oxidation resistance, and due to their presence in the diffusion zone, the diffusion zone has poorer resistance to oxidation than the outer zone and the substrate. Thus, once the crack reaches the diffusion zone, oxidation of the crack surfaces proceeds at a rate which is more rapid than the rate in either the outer zone or the substrate, thereby significantly decreasing the crack propagation rate.

The overlay coating used in making the invention aluminide coating can be applied by, e.g., plasma spraying, electron beam evaporation, electroplating, sputtering, or slurry deposition. Preferably, the overlay coating is applied by plasma spraying powder particles having the following composition, on a weight percent basis: 10–40 Co, 5–30 Cr, 5–15 Al, 0.1–5 Y, 0.1–7 Si, 0.1–2Hf. A more preferred composition range is 20–24 Co, 12–20 Cr, 10–14 Al, 0.1–3.5 Y, 0.1–7 Si, 0.1–2 Hf. The most preferred composition is about 22 Co, 17 Cr, 12.5 Al, 0.6 Y, 0.4 Si, 0.2 Hf. The combined amounts of yttrium, silicon and hafnium which should be in the overlay coating is between about 0.5 and 9 weight percent. A more preferred range is about 0.5–6%. Most preferably, the combined yttrium, silicon and hafnium content is about 1.2%. The plasma spray operation is preferably a vacuum or low pressure plasma spray operation, and powder particles are substantially molten when they strike the substrate surface. See U.S. Pat. No. 4,585,481, the contents of which are incorporated by reference.

After the overlay coating has been applied to the surface of the superalloy component, aluminum is diffused completely through the overlay coating and into the superalloy substrate. Preferably, the overlay coated component is aluminized using pack cementation techniques. During the aluminizing process, aluminum reacts with the overlay coating to transform the overlay into an aluminide coating enriched with oxygen active elements, i.e., enriched with yttrium, silicon and hafnium. While pack cementation according to e.g., U.S. Pat. No. 3,544,348 is the preferred method for diffusing aluminum into and through the overlay, aluminum may be diffused by gas phase deposition, or by, e.g., applying a layer of aluminum (or an alloy thereof) onto the surface of the overlay, and then subjecting the coated component to a heat treatment which will diffuse the aluminum layer through the overlay and into the superalloy substrate. The layer of aluminum can also be deposited by techniques such as electroplating, sputtering, flame spraying, or by slurry techniques, followed by a heat treatment.

The present invention may be better understood through reference to the following example which is meant to be illustrative rather than limiting.

EXAMPLE I

Powder having a nominal particle size range of 5–44 microns and a nominal composition of, on a weight percent basis, 22 Co, 17 Cr, 12.5 Al, 0.6 Y, 0.4 Si, 0.2 Hf, balance nickel, was plasma sprayed onto the surface of a nickel base superalloy having a nominal composition of 10 Cr, 5 Co, 4 W, 1.5 Ti, 12 Ta, 5 Al, balance nickel. The powder was sprayed using a low pressure chamber spray apparatus (Model 005) sold by the Electro Plasma Corporation. The spray apparatus included a sealed chamber in which the specimens were sprayed; the chamber was maintained with an argon atmosphere at a reduced pressure of about 50 millimeters Hg. The plasma spraying was conducted at about 50 volts and 1,520 amperes with 85% Ar-15% He arc gas. At these conditions, the powder particles were substantially molten when they impacted the superalloy surface. A powder feed rate of about 0.3 pounds per minute was used, and the resultant overlay produced was about 0.001 inches thick and was similar to the coating shown in FIG. 1.

After the overlay coating was applied to the superalloy surface, it was glass bead peened at an intensity of 0.017–0.001 inches N, and then the component was aluminized in a pack cementation mixture which contained, on a weight percent basis, 10 $Co_2Al_5$, 1 Cr, 0.5 $NH_4Cl$, balance $Al_2O_3$. The aluminizing process was carried out at 1,875° F for 3 hours, in an argon atmosphere. The coated component was then given a diffusion heat treatment at 1,975° F for 4 hours and a precipitation heat treatment at 1,600° F for 32 hours.

Metallographic examination of the aluminized overlay coated nickel base superalloy component revealed a duplex microstructure, similar to that shown in FIG. 2; the outer zone was about 0.002 inches thick, and the diffusion zone was about 0.001 inches thick. Thus, the combined coating thickness (outer zone plus diffusion zone) was about 0.003 inches thick, and was about 200% greater than the initial overlay coating thickness. Additionally, the diffusion zone extended inward of the outer zone an amount equal to about 50% of the outer zone thickness. Preferably, the diffusion zone thickness is at least about 30% of the thickness of the outer zone. The nominal composition of the outer zone was determined by electron microprobe microanalysis, which revealed that, on a weight percent basis, the aluminum concentration was about 24–31,the yttrium concentration was about 0.2–0.3, the hafnium concentration was about 0.05–0.15, the silicon concentration was about 0.1–0.2, the chromium concentration was about 5–18, the cobalt concentration was less than about 30, with the balance essentially nickel. The diffusion zone contained a lesser aluminum concentration than the outer zone, and a greater aluminum concentration than the substrate. In general, the aluminum concentration in the diffusion zone decreased as a function of depth, although the desirable properties of the coating of the present invention is not dependent on such an aluminum gradient in the diffusion zone. The diffusion zone also contained compounds of the substrate elements.

In oxidation testing conducted at 2,100° F, the invention coating protected the substrate from degradation for about 1,250 hours, which was at least equivalent to the protection provided by a plasma sprayed NiCoCrAlY+Hf+Si overlay. In thermal mechanical fatigue testing, wherein specimens were subjected to a strain rate of 0.5% while being alternately heated to a temperature of 800° and 1,900° F, coated nickel base single crystal superalloy test specimens had a life to failure of about 15,000 cycles, which was at least comparable to the life of a thin aluminide coated specimen (Aluminide B of FIG. 2).

EXAMPLE II

Powder having a nominal size range of 5–44 microns and a nominal composition of, on a weight percent basis, 22 Co, 17 Cr, 12.5 Al, 0.6 Y, 0.Si, 0.2 Hf balance nickel was plasma sprayed onto the nickel base superalloy described in Example I using the same parameters described in Example I.

The coating was then glass bead peened and aluminized as described in Example I. Oxidation testing at 2,100° F showed the coating to be protective of the substrate for a period of time of about 1,250 hours.

EXAMPLE III

Powder having a nominal particle size of about 5–44 microns and a nominal composition of, on a weight percent basis, 22 Co, 17 Cr, 12.5 Al, 0.5 Y, 2.2 Si was plasma sprayed onto the nickel base superalloy described in Example I, using the parameters described in Example I. The coating was also peened and aluminized as described in Example I. In oxidation testing at 2100° F, the coating protected the substrate for about 900 hours.

EXAMPLE IV

Powder having a nominal composition of, on a weight percent basis, 22 Co, 17 Cr, 12.5 Al, 0.3 Y, 0.5 Si, 0.6 Ce was sprayed, peened and aluminized as described in Example I. In oxidation tests at 2,100° F, the coating protected the substrate for a period of time of about 750 hours.

EXAMPLE V

Powder having a nominal composition of, on a weight percent basis, 22 Co, 17 Cr, 12.5 Al, 0.3 Y, 1.2 Hf was sprayed, peened and aluminized as described in Example I. In oxidation testing at 2,100° F, the coating protected the substrate for a period of time of about 650 hours.

EXAMPLE VI

Oxidation testing of a simple aluminide coating applied in the manner generally described by Boone et al. in U.S. Pat. No. 3,544,348 was oxidation tested at 2,100° F. The aluminide coating protected the substrate from oxidation for a period of time of about 375 hours.

Thus, the coatings described in the aforementioned Examples I–V, all being aluminized overlay coatings, had significantly greater resistance to oxidation than the simple aluminide coating of Example VI.

Although the invention has been shown and described with respect to a preferred embodiment thereof, it should be understood by those skilled in the art that other various changes and omissions in the form and detail thereof may be made therein without departing from the spirit and scope of the invention. Even though the Examples discussed above, show that the combination of yttrium, silicon and hafnium are preferred elements in the overlay coating, other elements which have similar oxygen active properties can be used. These elements include cerium, and the other rare earth elements, as those elements are known to those skilled in the art. At least two of such oxygen active elements should be present in the overlay coating, in an amount which ranges between 0.5 and 9 weight percent.

We claim:

1. An article having resistance to oxidation and thermal mechanical fatigue comprising a substrate selected from the group consisting of nickel and cobalt base superalloys, and a coating 0.001–0.005 inches thick diffused with the substrate, wherein the coating has an outer zone and a diffusion zone inward thereof, the outer zone consisting essentially of, by weight percent, 21–35 Al, 0.1–5 Y, 0.1–7 Si, 0.1–2 Hf, 5–30 Cr, 10–40 Co, and the balance nickel, and the diffusion zone having a lesser concentration of aluminum than the outer zone.

2. The article of claim 1 wherein the aluminum concentration in the diffusion zone decreases as a function of thickness.

3. A process for producing a coated nickel or cobalt base superalloy article having resistance to oxidation and thermal fatigue, comprising the steps of:

(a) applying a 0.0005–0.003 inch thick overlay coating to the superalloy surface, wherein said overlay coating contains yttrium, silicon and hafnium; and (b) diffusing aluminum through the overlay coating and into the superalloy substrate so as to form a coating characterized by an outer coating zone containing about 21–35 weight percent aluminum and a diffusion zone between the outer zone and the substrate, wherein the diffusion zone has a lesser concentration of aluminum than the outer zone and the combined thickness of the outer coating zone and the diffusion zone is about 0.001–0.005 inches.

4. The process of claim 3, wherein the overlay is applied to a thickness of between 0.0005 and 0.0015 inches.

5. The process of claim 3, wherein the combined thickness of the outer zone and diffusion zone is at least about 100% greater than the initial overlay coating thickness.

6. The process of claim 3, wherein the overlay is applied by plasma spraying powder in such a manner that the powder particles are substantially molten when they strike the superalloy surface.

7. The process of claim 6, wherein said plasma spray powder contains at least 5 weight percent aluminum.

8. The article of claim 4, wherein the coating thickness is about 0.002–0.003 inches.

9. The process of claim 5, wherein the combined thickness of the coating is about 0.002–0.003 inches.

10. The process of claim 6, wherein the overlay coating is applied by a low pressure plasma spray process.

11. The process of claim 3 wherein the overlay coating is peened before the step of diffusing.

12. The process of claim 3, wherein the overlay coating applied in step (a) consists essentially of, by weight percent. 10–40Co, 5–30Cr, 5–15Al, 0.1–5Y, 0.1–7Si, 0.1–2Hf, balance Ni.

13. The process of claim 12, wherein the overlay coating consists essentially of, by weight percent, about 22 Co, 17 Cr, 12.5 Cr, 0.6 Y, 0.4 Si, 0.2 Hf, balance Ni.

14. The process of claim 12, wherein the combined amount of yttrium, silicon and hafnium in the overlay coating is between about 0.5 and 9 percent.

15. The process of claim 12, wherein the combined amount of yttrium, silicon and hafnium in the overlay coating is between about 0.5 and 6 percent.

16. The process of claim 12, wherein the combined amount of yttrium, silicon and hafnium in the overlay coating is between about 1.2 percent.

17. A process for producing a coated nickel or cobalt base superalloy article having resistance to oxidation and thermal fatigue, comprising the steps of:

(a) applying a 0.0005–0.003 inch thick overlay coating to the superalloy surface, wherein said overlay coating contains at least two oxygen active elements in a combined amount between about 0.5 and 9 weight percent; and (b) diffusing aluminum through the overlay coating and into the superalloy substrate so as to form a coating characterized by an outer coating zone containing about 21–35 weight percent aluminum and a diffusion zone between the outer zone and the substrate, wherein the diffusion zone has a lesser concentration of aluminum than the outer zone and the combined thickness of the outer coating zone and the diffusion zone is about 0.001–0.005 inches.

* * * * *